US011350811B2

(12) United States Patent
Durham et al.

(10) Patent No.: US 11,350,811 B2
(45) Date of Patent: Jun. 7, 2022

(54) DISHWASHING APPLIANCES AND METHODS FOR ADDRESSING OBSTRUCTIONS THEREIN

(71) Applicant: Haier US Appliance Solutions, Inc., Wilmington, DE (US)

(72) Inventors: Kyle Edward Durham, Louisville, KY (US); Christopher Brandon Ross, Louisville, KY (US); Craig Curtis, Crestwood, KY (US); Mark Thomas Fryman, Lousiville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 62 days.

(21) Appl. No.: 16/417,704

(22) Filed: May 21, 2019

(65) Prior Publication Data

US 2020/0367716 A1 Nov. 26, 2020

(51) Int. Cl.
*A47L 15/42* (2006.01)
*A47L 15/00* (2006.01)

(52) U.S. Cl.
CPC ..... *A47L 15/4225* (2013.01); *A47L 15/0049* (2013.01); *A47L 15/4208* (2013.01); *A47L 2401/08* (2013.01); *A47L 2401/14* (2013.01); *A47L 2401/34* (2013.01)

(58) Field of Classification Search
CPC ... A47L 15/00–508; D06F 33/47; D06F 33/74
See application file for complete search history.

(56) References Cited

U.S. PATENT DOCUMENTS

| | | | | |
|---|---|---|---|---|
| 7,350,527 | B2 | 4/2008 | Gurubatham et al. | |
| 9,565,987 | B2 | 2/2017 | Poyner et al. | |
| 9,936,850 | B2 | 4/2018 | Becker et al. | |
| 2009/0000671 | A1 | 1/2009 | Montagnana | |
| 2012/0017944 | A1* | 1/2012 | Delle | A47L 15/0015 134/25.2 |
| 2012/0125369 | A1* | 5/2012 | Pers | A47L 15/4217 134/18 |
| 2013/0008477 | A1* | 1/2013 | Forst | A47L 15/0023 134/57 D |
| 2014/0158163 | A1* | 6/2014 | Montgomery | A47L 15/0018 134/18 |
| 2014/0360530 | A1* | 12/2014 | Pers | A47L 15/0049 134/18 |
| 2018/0014713 | A1* | 1/2018 | Hofmann | A47L 15/4208 |
| 2019/0357749 | A1* | 11/2019 | Persson | A47L 15/0031 |

FOREIGN PATENT DOCUMENTS

| | | | |
|---|---|---|---|
| CN | 101822521 A | * | 9/2010 |
| CN | 101822521 B | | 12/2011 |
| WO | WO2018153472 A1 | | 8/2018 |

* cited by examiner

*Primary Examiner* — Michael E Barr
*Assistant Examiner* — Omair Chaudhri
(74) *Attorney, Agent, or Firm* — Dority & Manning, P.A.

(57) ABSTRACT

Dishwashing appliances and methods, as provided herein, may include features or steps such as detecting a pressure (P1) at a pressure sensor upstream from a pump while maintaining the pump in an inactive state and activating the pump from the inactive state for an activation period during which the pump remains active to motivate a continuous fluid flow. Dishwashing appliances and methods may further include features or steps for detecting a pressure (P2) at the pressure sensor upstream from the pump during the activation period and initiating a response sequence at the pump based on P1 and P2.

15 Claims, 7 Drawing Sheets

DISHWASHING APPLIANCES AND METHODS FOR ADDRESSING OBSTRUCTIONS THEREIN

FIELD OF THE INVENTION

The present subject matter relates generally to dishwashing appliances, and more particularly to features and methods for addressing obstructions or clogs in a dishwashing appliance.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash fluid (e.g., water, detergent, etc.) towards articles disposed within the rack assemblies in order to clean such articles. Dishwashing appliances are also typically equipped with one or more pumps, such as a circulation pump or a drain pump, for directing or motivating wash fluid from the wash chamber (e.g., to the spray assemblies or an area outside of the dishwashing appliance).

Conventional dishwashing appliances include one or more filter assemblies for filtering the wash fluid exiting the wash chamber. Depending upon the level of soil upon the articles, fluids used during wash and rinse cycles will become contaminated with sediment (e.g., soil, food particles, etc.) in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump. As a result, a filter assembly may be provided within or below a sump portion of the tub.

Over time and after repeated use of a dishwashing appliance, sediment may accumulate within a filter assembly. If left unaddressed, the accumulation may lead to obstructions or clogs in the sump, pump, or another portion of a fluid flow path. This may produce undesirable noises, impair appliance performance, and may even damage the dishwashing appliance. It may be useful for a filter assembly to be regularly cleaned, but this can be difficult for a user. Often, users are unaware of the recommended cleaning schedule for the filter assembly. Moreover, certain conventional dishwashing appliances do not have a filter that is readily accessible or serviceable to a user.

Accordingly, dishwashing appliances that include features for addressing or monitoring obstructions within a filter assembly and methods therefore that address one or more of the challenges noted above would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The method may include steps for detecting a pressure (P1) at a pressure sensor upstream from a pump while maintaining the pump in an inactive state and activating the pump from the inactive state for an activation period during which the pump remains active to motivate a continuous fluid flow. The method may include steps for detecting a pressure (P2) at the pressure sensor upstream from the pump during the activation period and initiating a response sequence at the pump based on P1 and P2.

In another exemplary aspect of the present disclosure, a dishwashing appliance is provided. The dishwashing appliance may include a cabinet, a tub, a spray assembly, a pump, a pressure sensor, and a controller. The tub may be positioned within the cabinet and may define a wash chamber for receipt of articles for washing. The spray assembly may be positioned within the wash chamber. The pump may be in fluid communication with the wash chamber. The pressure sensor may be upstream of the pump. The controller may be in operative communication with the pressure sensor and the pump. The controller may be configured to initiate a wash operation. The wash operation may include detecting a pressure (P1) at the pressure sensor upstream from the pump while maintaining the pump in an inactive state, activating the pump from the inactive state for an activation period during which the pump remains active to motivate a continuous fluid flow, detecting a pressure (P2) at the pressure sensor upstream from the pump during the activation period, and initiating a response sequence at the pump based on P1 and P2.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
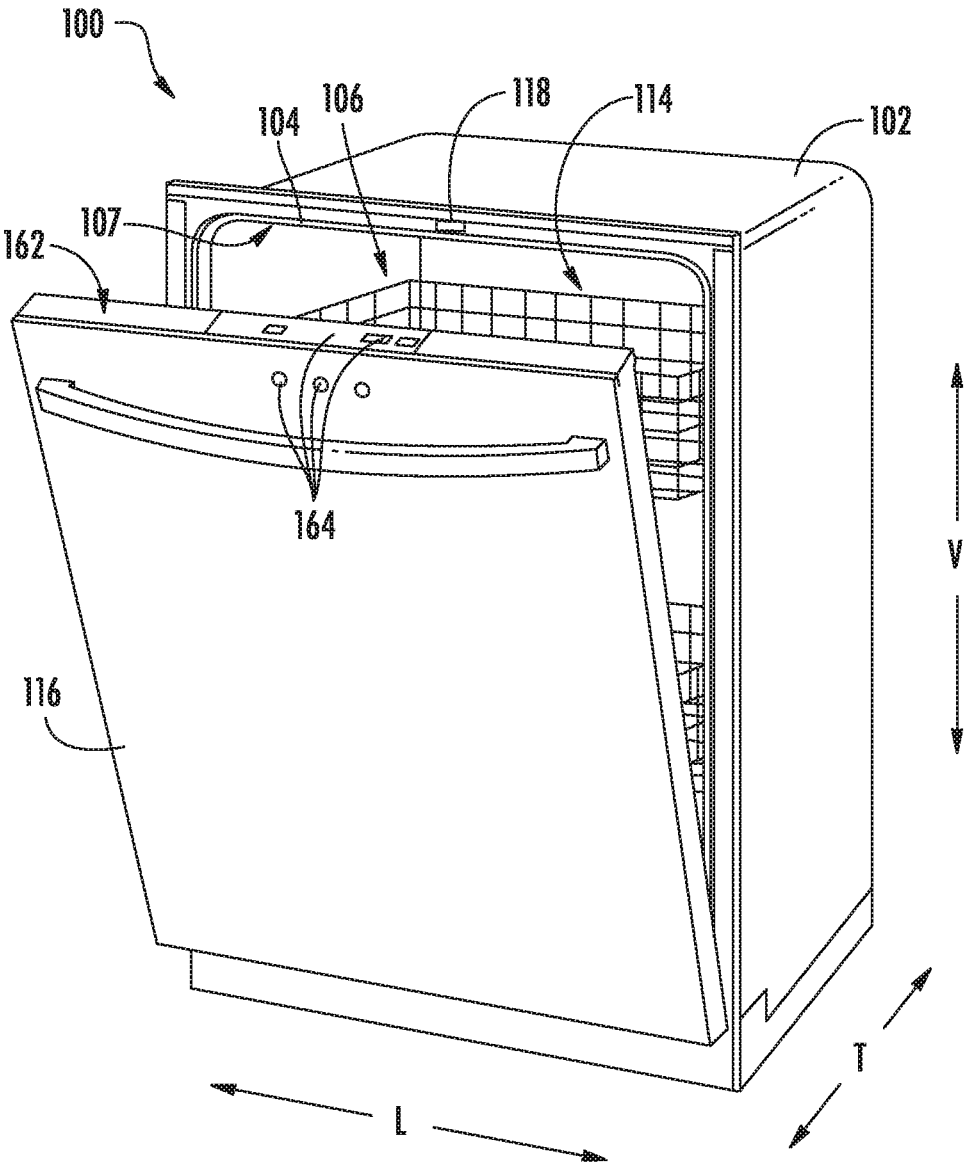
FIG. 1 provides a perspective view of an exemplary embodiment of a dishwashing appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a wash fluid (e.g., water, detergent, or wash additive). The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing or rinsing the articles that is typically made up of water and may include additives, such as detergent or other treatments (e.g., rinse aid). Furthermore, as used herein, terms of approximation, such as "approximately," "substantially," or "about," refer to being within a ten percent (10%) margin of error.

Figure 2:
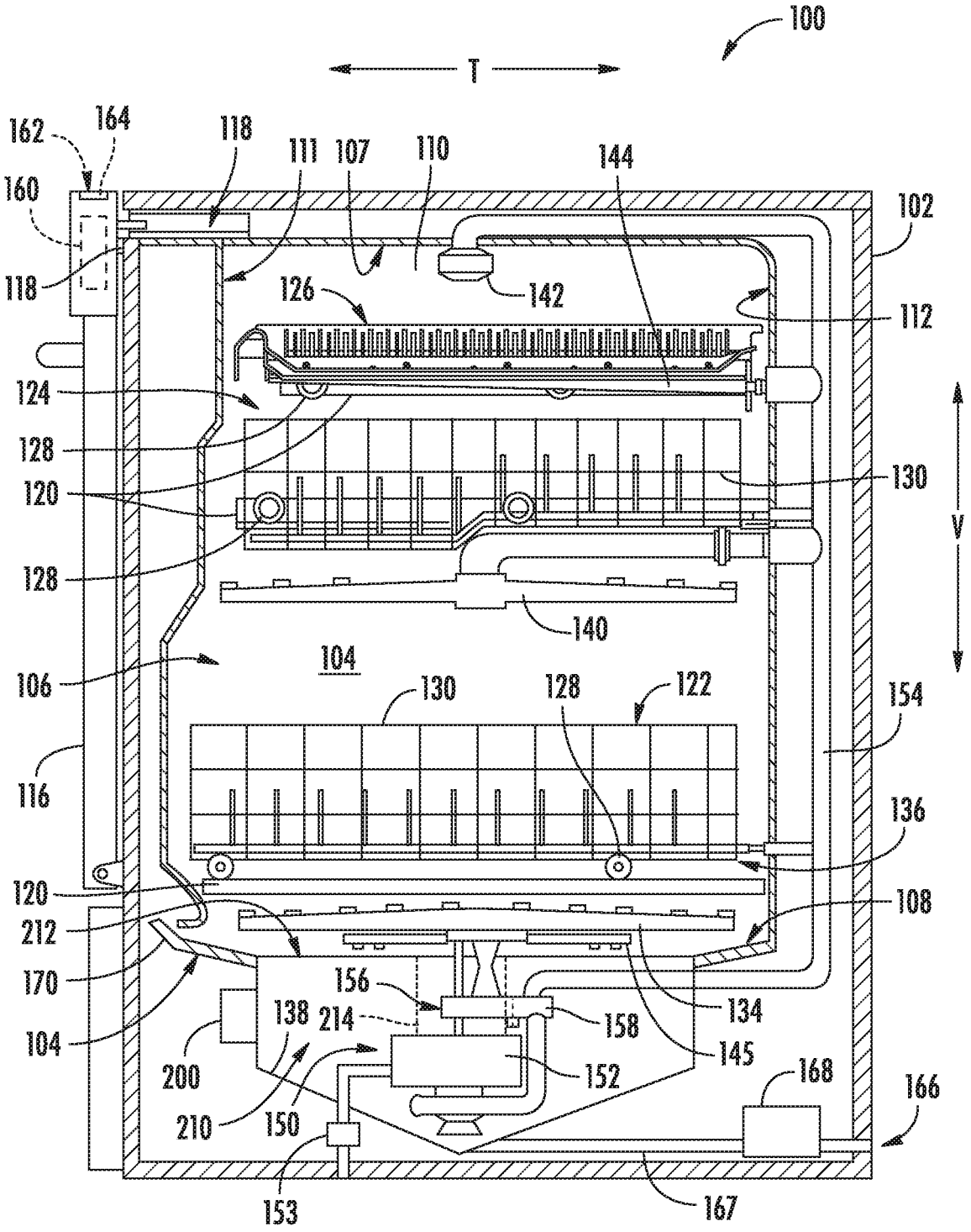
FIG. 2 provides a side, cross sectional view of the exemplary dishwashing appliance of FIG. 1.

Turning now to the figures, FIGS. 1 and 2 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114. In some embodiments, a door 116 hinged at its bottom for movement between a normally closed vertical position, wherein the wash chamber 106 is sealed shut for washing operation, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively.

Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to additional or alternative embodiments, a silverware basket (not shown) is removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash fluid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash fluid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash fluid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash fluid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210. For instance, filter clean spray assembly 145 may be directed downward to urge a flow of wash fluid across a portion of filter assembly 210 (e.g., first filter 212) or sump 138.

The various spray assemblies and manifolds described herein may be part of a fluid distribution system or fluid circulation assembly 150 for circulating wash fluid in tub 104. In certain embodiments, fluid circulation assembly 150 includes a circulation pump 152 for circulating wash fluid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 can be positioned between the external water supply line and circulation pump 152 (e.g., to selectively allow water to flow from the external water supply line to circulation pump 152). Additionally or alternatively, water inlet valve 153 can be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash fluid throughout wash chamber 106.

In some embodiments, primary supply conduit 154 is used to supply wash fluid to one or more spray assemblies (e.g., to mid-level spray arm assembly 140 or upper spray assembly 142). It should be appreciated, however, that according to alternative embodiments, any other suitable plumbing configuration may be used to supply wash fluid throughout the various spray manifolds and assemblies described herein. For instance, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwashing appliance 100.

Each spray arm assembly 134, 140, 142, integral spray manifold 144, filter clean assembly 145, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In some embodiments, an exemplary filter assembly 210 is provided. As shown, in exemplary embodiments, filter assembly 210 is located in the sump 138 (e.g., to filter fluid to circulation assembly 150). Generally, filter assembly 210 removes soiled particles from the fluid that is recirculated through the wash chamber 106 during operation of dishwashing appliance 100. In exemplary embodiments, filter assembly 210 includes both a first filter 212 (also referred to as a "coarse filter") and a second filter 214 (also referred to as a "fine filter").

In some embodiments, the first filter 212 is constructed as a grate having openings for filtering fluid received from wash chamber 106. The sump 138 includes a recessed portion upstream of circulation pump 152 or a drain pump 168 and over which the first filter 212 is removably received. In exemplary embodiments, the first filter 212 operates as a coarse filter having media openings in the range of about 0.030 inches to about 0.060 inches. The recessed portion may define a filtered volume wherein debris or particles have been filtered by the first filter 212 or the second filter 214.

In additional or alternative embodiments, the second filter 214 is provided upstream of circulation pump 152 or drain pump 168. Second filter 214 may be non-removable or, alternatively, may be provided as a removable cartridge positioned in a tub receptacle formed in sump 138. For instance, the second filter 214 may be removably positioned within a collection chamber defined by the tub receptacle. The second filter 214 may be generally shaped to complement the tub receptacle. For instance, the second filter 214 may include a filter wall that complements the shape of the tub receptacle. In some embodiments, the filter wall is formed from one or more fine filter media. Some such embodiments may include filter media (e.g., screen or mesh, having pore or hole sizes in the range of about 50 microns to about 600 microns). When assembled, the filter wall may define an internal chamber. In optional embodiments, a top portion of fine filter positioned above the internal chamber may define one or more openings of the filter wall, thereby permitting fluid to flow into the internal chamber without passing through the first filter 212 or the fine filter media of the filter wall of the second filter 214.

During operation of some embodiments (e.g., during or as part of a wash cycle or rinse cycle), circulation pump 152 draws wash fluid in from sump 138 through filter assembly (e.g., through first filter 212 or second filter 214). Thus, circulation pump 152 may be downstream of filter assembly 210.

In optional embodiments, circulation pump 152 urges or pumps wash fluid (e.g., from filter assembly 210) to a diverter 156. In some such embodiments, diverter 156 is positioned within sump 138 of dishwashing appliance 100). Diverter 156 may include a diverter disk (not shown) disposed within a diverter chamber 158 for selectively distributing the wash fluid to the spray arm assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash fluid to the desired spray device.

In exemplary embodiments, diverter 156 is configured for selectively distributing the flow of wash fluid from circulation pump 152 to various fluid supply conduits—only some of which are illustrated in FIG. 2 for clarity. In certain embodiments, diverter 156 includes four outlet ports (not shown) for supplying wash fluid to a first conduit for rotating lower spray arm assembly 134, a second conduit for supplying wash fluid to filter clean assembly 145, a third conduit for spraying an auxiliary rack such as the silverware rack, and a fourth conduit for supply mid-level or upper spray assemblies 140, 142 (e.g., primary supply conduit 154).

Drainage of soiled wash fluid within sump 138 may occur, for instance, through drain assembly 166 (e.g., during or as part of a drain cycle). In particular, wash fluid may exit sump 138 through a drain and may flow through a drain conduit 167. In some embodiments, a drain pump 168 downstream of sump 138 facilitates drainage of the soiled wash fluid by urging or pumping the wash fluid to a drain line external to dishwasher 100. Drain pump 168 may be downstream of first filter 212 or second filter 214. Additionally or alternatively, an unfiltered flow path may be defined through sump 138 to drain conduit 167 such that an unfiltered fluid flow may pass through sump 138 to drain conduit 167 without first passing through either first filter 212 or second filter 214.

Although a separate recirculation pump 152 and drain pump 168 are described herein, it is understood that other suitable pump configurations (e.g., using only a single pump for both recirculation and draining) may be provided.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation that may include a wash cycle, rinse cycle, or drain cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry—such as switches, amplifiers, integrators, comparators, flip-flops, AND gates, and the like—to perform control functionality instead of relying upon software).

Controller 160 may be positioned in a variety of locations throughout dishwasher 100. In optional embodiments, controller 160 is located within a control panel area 162 of door 116 (e.g., as shown in FIGS. 1 and 2). Input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electromechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For instance, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure.

Figure 3:
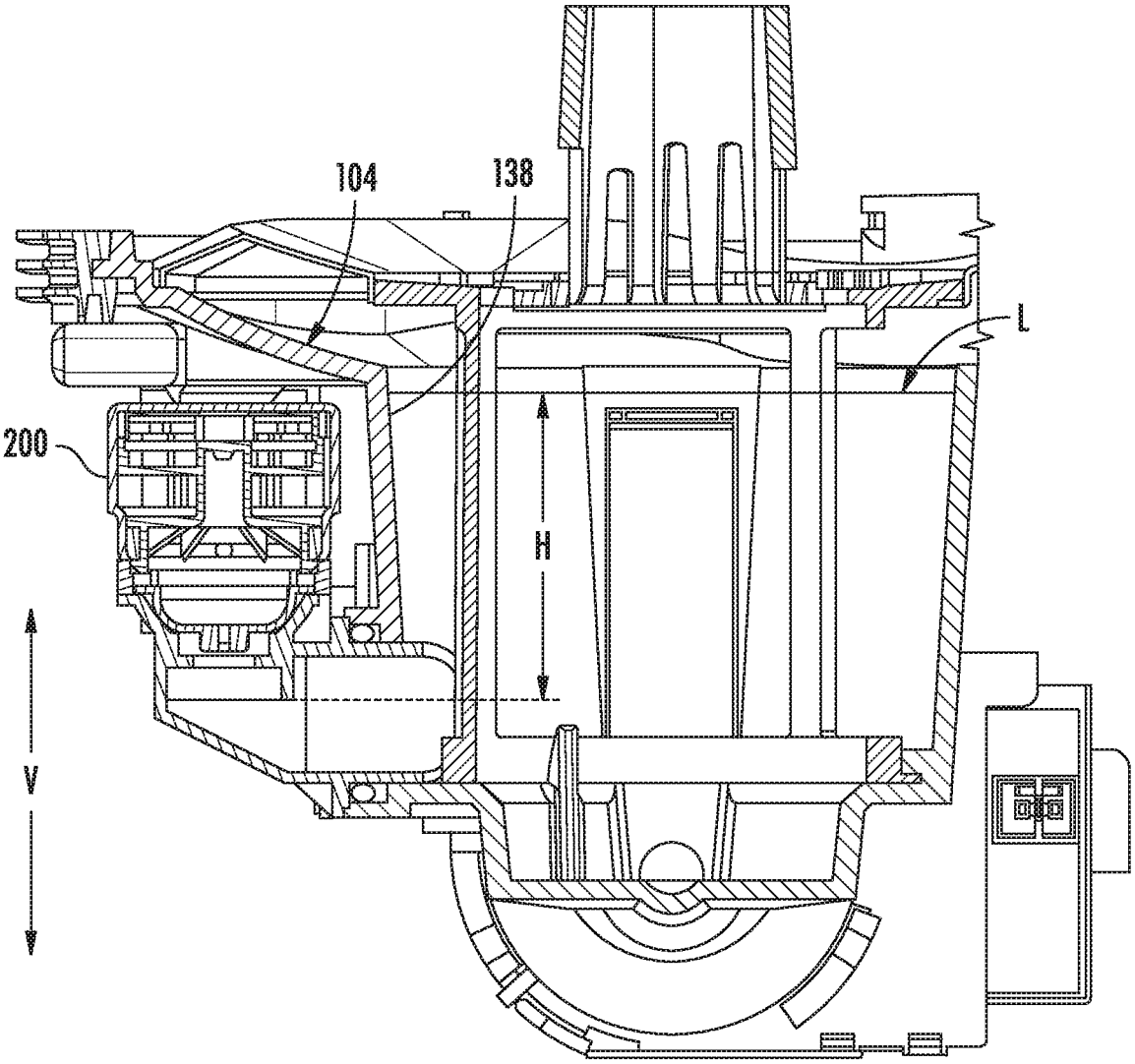
FIG. 3 provides a close up, cross sectional view of a sump and a pressure sensor of the dishwashing appliance of FIGS. 1 and 2.

Turning especially to FIG. 3, a close up, cross sectional view of sump 138 and a pressure sensor 200 is provided. In some instances, portions of dishwasher 100 may become obstructed or clogged (e.g., at filter assembly 210). Accordingly, and in accordance with exemplary aspects of the present disclosure, dishwasher 100 utilizes outputs from pressure sensor 200 to monitor or prevent obstructions or clogs.

In some embodiments, pressure sensor 200 mounted to sump 138. Pressure sensor 200 is operatively configured to detect a liquid level L within sump 138 and communicate the liquid level L to controller 160 (FIG. 2) via one or more signals. Thus, pressure sensor 200 and controller 160 are generally provided in operative communication.

During use, pressure sensor 200 may transmit signals to controller 160 for instance, as a frequency, as an analog signal, or in another suitable manner or form that can be received by controller 160 to detect a pressure value (e.g., as a value of relative pressure or hydrostatic pressure, such as value in units of $mmH_2O$). In certain embodiments, pressure sensor 200 is configured to sense the height H of the wash fluid above pressure sensor 200 along the vertical direction V (e.g., by detecting the pressure on pressure sensor 200). For instance, pressure sensor 200 may include a pressure plate that is generally acted on by the pressure of the wash fluid within sump 138. As the liquid level L rises, the pressure plate is pushed upward along the vertical direction V and, thus, compresses air trapped within the housing and a diaphragm of pressure sensor 200. Compression may cause the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. Optionally, the signals from pressure sensor 200 may be linearized, digitized, or amplified before being sent to controller 160 for processing. Additionally or alternatively, the pressure sensor 200 may include a printed circuit board (PCB) board to electrically connect the various electrical components of pressure sensor 200. Moreover, pressure sensor 200 can be any suitable type of sensor capable of sensing the liquid level L within dishwasher 100.

Notably, as an upstream sensor (e.g., upstream of circulation pump 152 or drain pump 168), signals from pressure sensor 200 may be used or configured for additional detections, such as detection of overfill or flood event (e.g., as would be caused by an out-of-level condition, an inlet water valve failure, or a drain pump failure) that would otherwise go undetected by a pressure sensor downstream (i.e., on the high-pressure side) of circulation pump 152 or drain pump 168.

Figure 4:
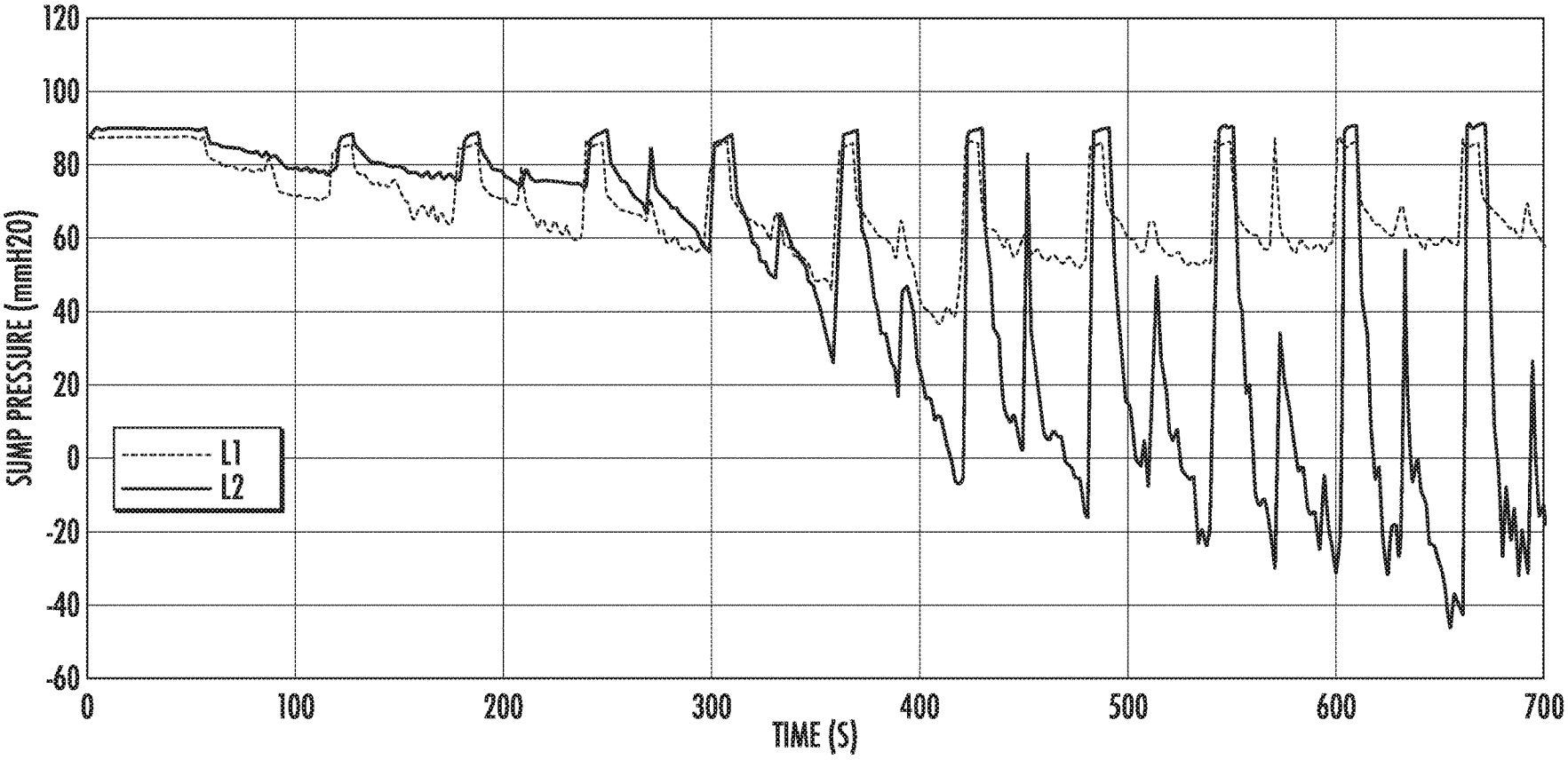
FIG. 4 provides a chart illustrating detected pressure over time during a dishwashing operation.

Turning briefly to FIG. 4, a chart is provided illustrating pressure values (e.g., detected at pressure sensor 200—FIG. 3) over a period of time. Line L1 depicts pressure during operation of an exemplary dishwasher (e.g., dishwasher 160—FIG. 1) (e.g., during a wash cycle, rinse cycle, or drain cycle) that is generally clean or otherwise free of obstructions/clogs (e.g., within a filter assembly 210 or pump 152,168—FIG. 2). Line L2 depicts pressure during operation of an exemplary dishwasher 100 that contains a notable obstruction/clog (e.g., within a coarse filter of filter assembly 210—FIG. 2). As shown, when obstructed, the dishwasher may suffer multiple repeated pressure-drop instances that can be detected or measured, as will be further described below.

Figure 5:
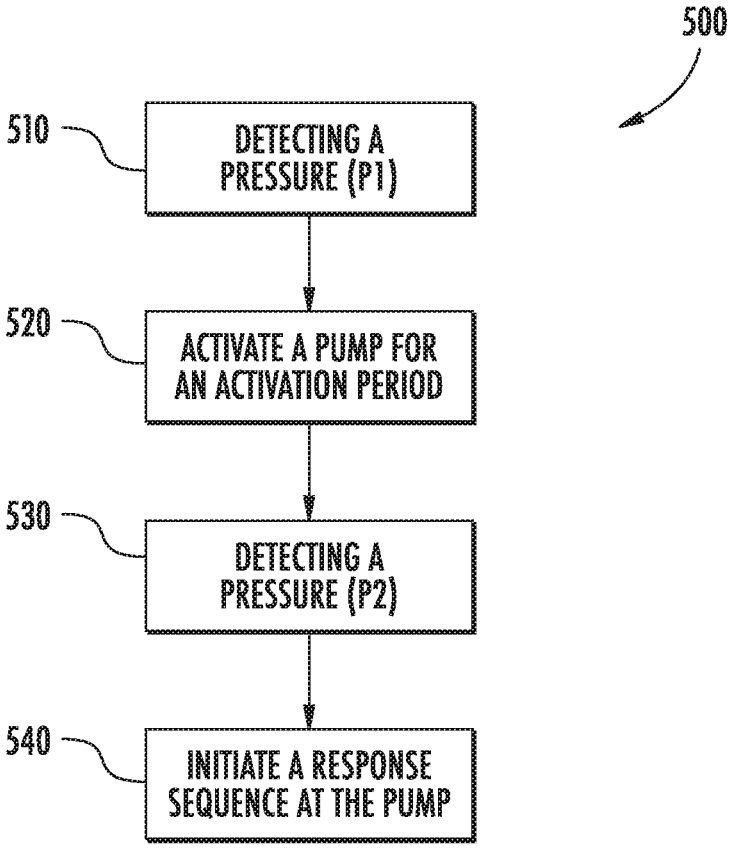
FIG. 5 provides a flow chart of a method of operating a dishwashing appliance, according to an exemplary embodiment of the present disclosure.
Figure 6:
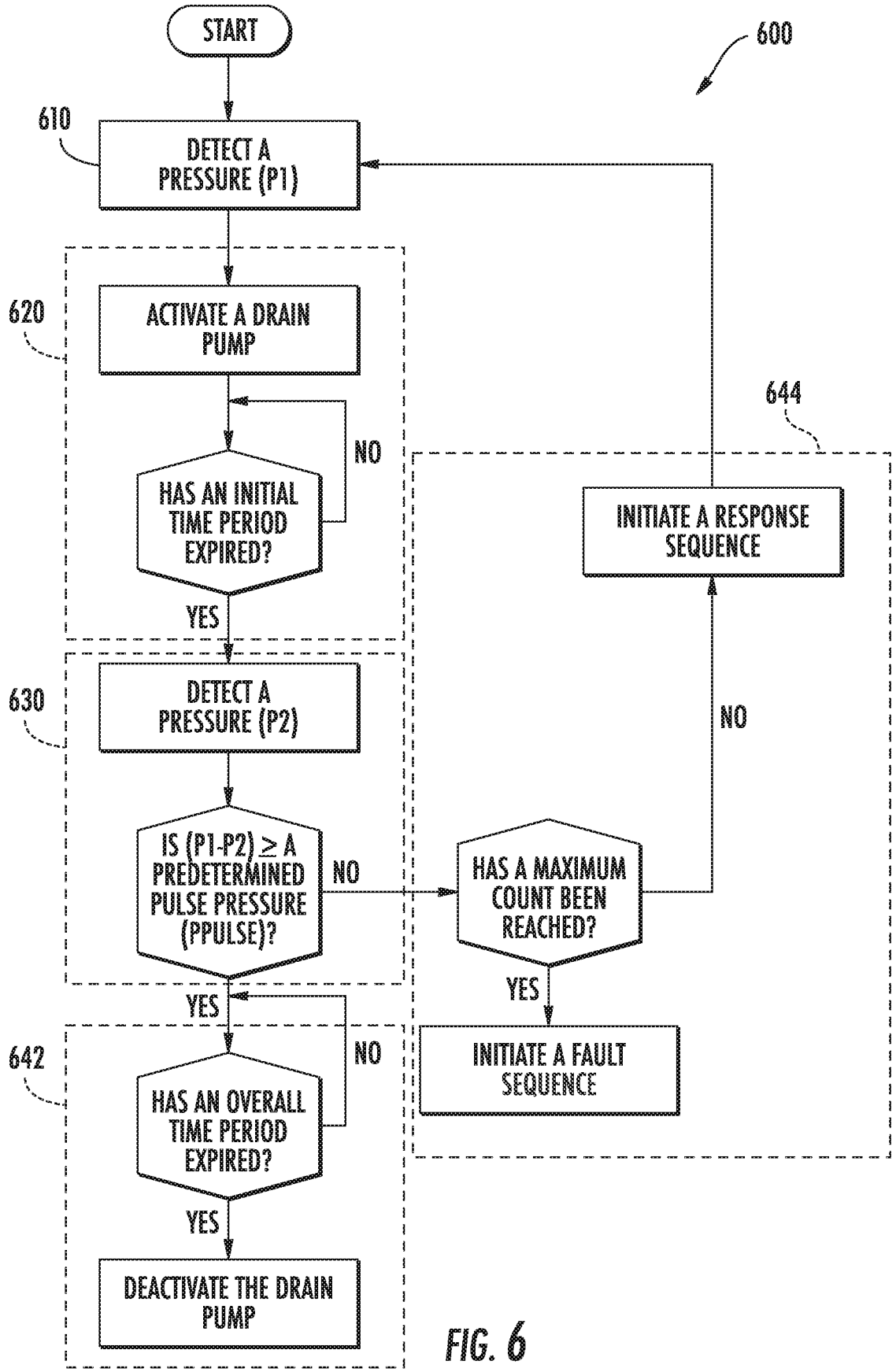
FIG. 6 provides a flow chart of a method of operating a dishwashing appliance, according to an exemplary embodiment of the present disclosure.
Figure 7:
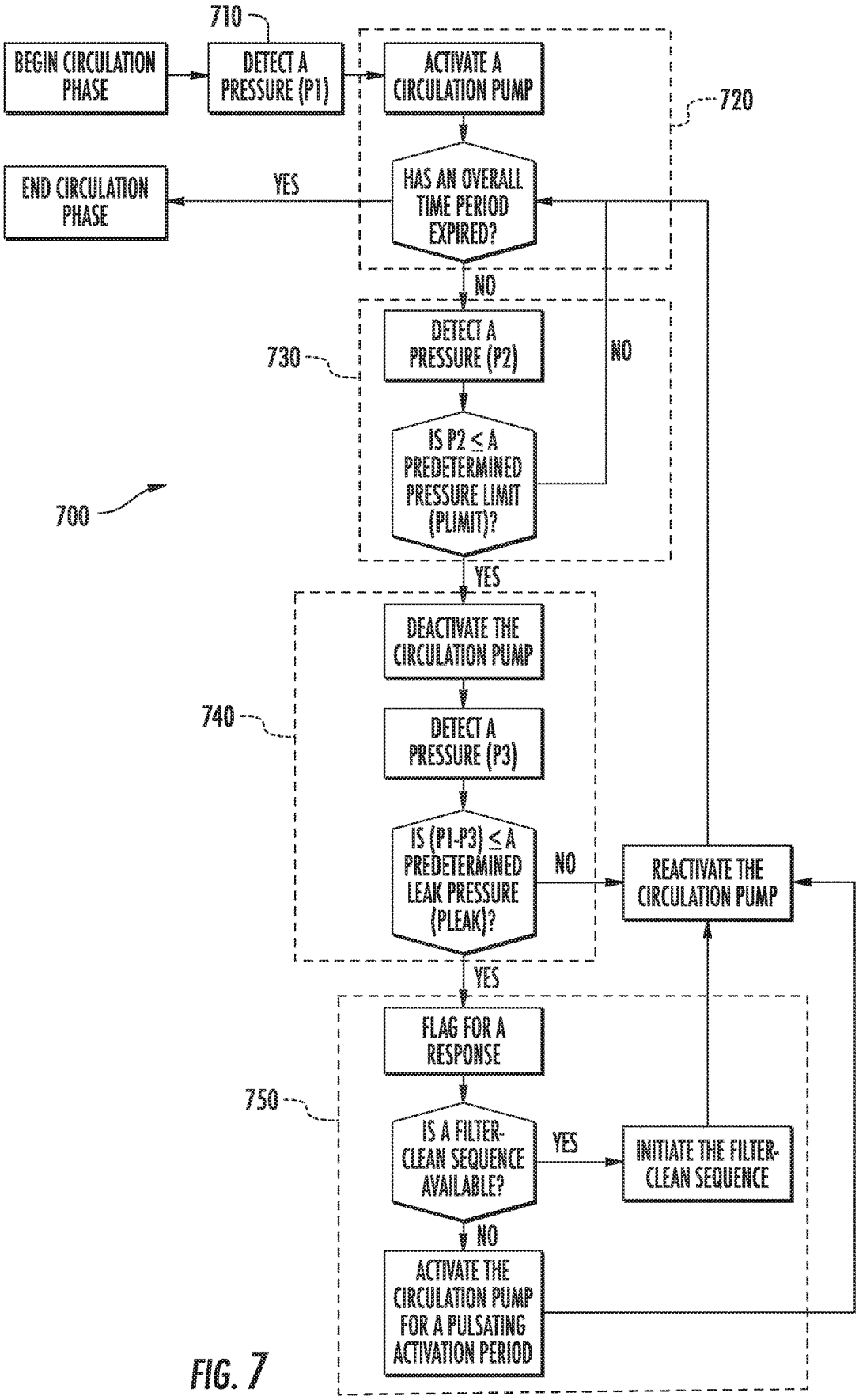
FIG. 7 provides a flow chart of a method of operating a dishwashing appliance, according to an exemplary embodiment of the present disclosure.

Turning now to FIGS. 5 through 7, various methods 500, 600, and 700 for operating a dishwashing appliance are illustrated. Methods 500, 600, and 700 may be used to operate any suitable dishwashing appliance. As an example, some or all of methods 500, 600, and 700 may be used to operate dishwashing appliance 100 (FIG. 1). The controller 160 (FIG. 2) may be programmed to implement some or all of methods 500, 600, and 700 (e.g., as or as part of a wash operation).

Turning specifically to FIG. 5, at 510, the method 500 includes detecting a pressure (P1) (e.g., as a value of relative pressure or hydrostatic pressure, such as value in units of $mmH_2O$) at the pressure sensor upstream from a pump while maintaining a pump (e.g., circulation pump or drain pump) in an inactive state. In some embodiments, 510 includes halting all fluid flow within the dishwashing appliance. For instance, all pumps in fluid communication with the wash chamber may be directed to or maintained in an inactive state such that no wash fluid is actively urged or pumped therethrough during 510. Additionally or alternatively, a water valve configured to direct water to the wash chamber, as described above, may be closed such that no new water is provided to wash chamber during 510. Thus, wash fluid within wash chamber may be generally static.

In certain embodiments, 510 follows (e.g., occurs subsequent to) a fill segment or phase of a wash cycle or rinse cycle. For instance, 510 may occur after (e.g., immediately after) a volume of wash fluid has been supplied to wash chamber. The wash chamber may be thus filled with a volume of wash fluid to be circulated by circulation pump as part of a programmed wash cycle or rinse cycle (e.g., as part of a circulation phase).

In additional or alternative embodiments, 510 follows an at least partially completed wash cycle or rinse cycle. In some embodiments, 510 occurs immediately prior to draining of wash chamber (e.g., as part of a drain cycle).

At 520, the method 500 includes activating the pump from the inactive state for an activation period (e.g., time period in which the pump is active). Thus, 520 follows 510. Generally, the pump remains active during the activation period. For instance, the pump may actively urge or motivate a fluid flow. The activation period may be a continuous activation period such that, for a predetermined period of time, the pump is directed to operate uninterrupted in an attempt to motivate a substantially continuous or non-pulsated fluid flow (e.g., as in continuous flow state).

If the pump is a circulation pump, the fluid flow at 520 may be directed through one or more conduits, diverters, or spray assemblies, as described above. If the pump is a drain pump, the fluid flow at 520 may be directed through the drain conduit and out of the dishwashing appliance, as described above.

At 530, the method 500 includes detecting a pressure (P2) (e.g., as a value of relative pressure in millimeters of water) at the pressure sensor upstream from the pump. Specifically, P2 is detected during the activation period. Thus, P2 may be an active pumping pressure. Moreover, 530 may occur after the initiation of the activation period at 520, but while the pump continues to actively operate to urge or motivate a fluid flow (e.g., in a continuous flow state).

In some embodiments, the method 500 includes evaluating the detected P2 alone (e.g., during a circulation phase of a wash cycle or rinse cycle). For instance, P2 may be compared to a predetermined limit pressure (Plimit) (e.g., as a value of relative pressure in millimeters of water). From the comparison, it may be determined whether P2 is less than or equal to Plimit.

In some embodiments, a determination that P2 is not less or equal to Plimit (i.e., P2 is greater than Plimit) may indicate normal or desirable fluid flow through the dishwashing appliance. Additionally or alternatively, the method 500 may detect a new pressure (e.g., a new P2 to be used in place of the previously-detected P2) while allowing the activation period and continued operation of the pump to proceed (e.g., until or unless an overall time period for 500 has expired). In other words, if P2 greater that Plimit, the method 500 may continue to monitor pressure while permitting uninterrupted operation of the pump.

In additional or alternative embodiments, if P2 less than or equal to Plimit, the method 500 may include deactivating the pump for a deactivation period during which the pump remains inactive. Moreover, the method 500 may include detecting a pressure (P3) at the pump sensor upstream from the pump during the deactivation period (i.e., while the pump remains inactive). Thus, P3 may be an inactive pumping pressure. Upon detecting P3, the method 500 may proceed to a new step (e.g., 540).

In optional embodiments, the method 500 provides for evaluating P1 and P2 together following 530. For instance, the method 500 may include calculating a difference (Pdiff) between P1 and P2. In some such embodiments, Pdiff is calculated by subtracting P2 from P1. In other words, Pdiff may equal P1 minus P2 (e.g., Pdiff=P1−P2). When calculated, Pdiff may represent the change in pressure (e.g., at the pressure sensor) from 510 to 530. Moreover, Pdiff may be compared to a predetermined pulse pressure (Ppulse) (e.g., as a value of relative pressure in millimeters of water), for instance, to determine if an excessive pressure change is detected.

In other optional embodiments, the method 500 provides for evaluating P1 and P3 together following 530 and detection of P3. For instance, the method 500 may include calculating a difference (Pcomp) between P1 and P3. In some such embodiments, Pcomp is calculated by subtracting P3 from P1. In other words, Pcomp may equal P1 minus P3 (e.g., Pcomp=P1−P3). When calculated, Pcomp may generally indicate the change in fluid volume within the wash chamber (e.g., at the pressure sensor) from 510 to 530. Moreover, Pcomp may be compared to a predetermined leak pressure (Pleak), for instance, to determine if a leak in the dishwashing appliance or a large article collecting wash fluid is present.

At 540, the method 500 includes initiating a response sequence at the pump based on P1 and P2. The response sequence may be selected from a plurality of predetermined sequences. In some such embodiments, 540 includes selecting the response sequence from the plurality of predetermined sequences. The selection may be similarly based on P1 and P2. Thus, the method 500 may provide for initiating different sequences depending on what values are detected for P1 and P2.

Depending, at least in part, on the values detected for P1 and P2, the response sequence may include a filter clean sequence, a pulsating sequence, a flagging sequence, a notification sequence, a pass-through sequence, or a halting sequence. Thus, the plurality of sequences may include one or more of the filter clean sequence, pulsating sequence, flagging sequence, notification sequence, pass-through sequence, or halting sequence.

The filter clean sequence may include directing wash fluid to one or more cleaning apertures of a spray assembly directed at the filter assembly. As an example, the pump may be activated (e.g., for a continuous or pulsating activation period) and the diverter may be actuated or positioned to direct wash fluid to the cleaner spray assembly. As another example, the diverter may be actuated or positioned to direct wash fluid to the lower spray assembly and, in particular, to one or more filter-cleaning apertures thereof (e.g., directed downward toward a coarse filter of the filter assembly).

The pulsating sequence may include activating the pump for a pulsating activation period during which the pump is active according to a set pulsating pattern. Thus, the pump may draw wash fluid at an interrupted pace with sequential, discrete pulses, as is understood. If the pump is a drain pump, wash fluid may be dispensed from the drain conduit at the interrupted pace. If the pump is a circulation pump, wash fluid may be dispensed from one or more spray assemblies at the interrupted pace.

The flagging sequence may include flagging or recording a discrete event. In particular, the recording of the discrete event may include information regarding detected pressure (e.g., P1, P2, P3, Pdiff, Pcomp, etc.), time, or any other relevant data of detected conditions within the wash chamber.

The notification sequence may include initiating an audio or visual alert. As an example, a controller may direct a speaker to generate an audible sound wave corresponding to a detected condition. As another example, a controller may direct a light source or display of the user interface to transmit a visual identifier corresponding to a detected condition.

The pass-through sequence may include directing the wash appliance to continue or resume the current or contemporary cycle without interruption (e.g., until a programmed condition for ending the cycle has been met).

The halting sequence may include immediately directing the wash appliance to halt the current or contemporary cycle irrespective of whether another programmed condition for ending the cycle has been met.

In some embodiments, a specific sequence is initiated at 540 based on Pdiff. As an example, if Pdiff is determined to be greater than or equal to Ppulse, a pass-through sequence may be initiated. In other words, the response sequence at 540 may be a pass-through sequence. If the current cycle is a drain cycle, the response sequence may thus include activating the drain pump for a continuous drain period during which the drain pump is active to direct liquid from the dishwashing appliance. As another example, if Pdiff is determined to be less than Ppulse, a pulsating sequence may be initiating. In other words, the response sequence at 540 may be a pulsating sequence. If the current cycle is a drain cycle, the response sequence may thus include activating the drain pump for a pulsating activation period during which the drain pump is active according to a set pulsating pattern.

In exemplary embodiments, a specific sequence is initiated at 540 based on Pcomp. As an example, if Pcomp is determined to be less than or equal to Pleak, a filter clean sequence or a pulsating sequence may be initiated. In other words, the response sequence at 540 may be a filter clean sequence or pulsating sequence, respectively. As another example, if Pcomp is determined to be greater than Pleak, a flagging sequence, notification sequence, pass-through sequence, or halting sequence. In other words, the response sequence at 540 may be a flagging sequence, notification sequence, pass-through sequence, or halting sequence, respectively.

Turning now to FIG. 6, the method 600 may describe operation of a dishwashing appliance (e.g., at the drain pump) during a drain cycle (e.g., following an at least partially completed wash cycle or rinse cycle). Thus, the method 600 may be initiated while a volume of wash fluid is contained within wash chamber.

At 610, the method 600 includes detecting a pressure (P1) (e.g., as a value of relative pressure or hydrostatic pressure, such as value in units of $mmH_2O$) at the pressure sensor upstream from the drain pump while maintaining the drain pump in an inactive state.

In some embodiments, 610 includes halting all fluid flow within the dishwashing appliance. For instance, all pumps in fluid communication with the wash chamber may be directed to or maintained in an inactive state such that no wash fluid is actively urged or pumped therethrough during 610. Additionally or alternatively, a water valve configured to direct water to the wash chamber, as described above, may be closed such that no new water is provided to wash chamber during 610. Thus, wash fluid within wash chamber may be generally static.

At 620, the method includes activating the drain pump for an initial time period. For instance, the drain pump may actively urge or motivate a fluid flow. In some embodiments, the activated drain pump is directed to operate uninterrupted in an attempt to motivate a substantially continuous or non-pulsated fluid flow (e.g., as in a continuous fluid flow). As described above, the fluid flow may be directed through the drain conduit and out of the dishwashing appliance.

Optionally, the initial time period may be a predetermined period of time starting at the point in time in which the drain pump is activated at 610. In some such embodiments, the initial time period may be less than or equal to 30 seconds (e.g., less than or equal to 30 seconds, 15 seconds, or 10 seconds). Additionally or alternatively, the initial time period may be more than or equal to 2 seconds (e.g., more than 2 seconds, 3 seconds, or 4 seconds). Further additionally or alternatively, the initial time period may be between 5 seconds and 10 seconds.

Upon expiration of the initial time period, the method 600 may proceed to 630 (e.g., while maintaining the drain pump in an active state)

At 630, the method 600 includes evaluating pressure at the pressure sensor. Specifically, the 630 may include detecting a pressure (P2) (e.g., as a value of relative pressure in millimeters of water) at the pressure sensor upstream from the drain pump while the drain pump continues to actively operate to urge or motivate a fluid flow. Thus, P2 may be an active pumping pressure.

As shown, once P2 is detected, 630 may include comparing a difference in P1 and P2 (e.g., Pdiff=P1−P2) to a predetermined pulse pressure (Ppulse), for instance, to determine if an excessive pressure change is detected.

If Pdiff is greater than or equal to Ppulse, it may be indicative that there is no significant obstruction or clog within the dishwashing appliance, and the method 600 may proceed to 642. If Pdiff is less than Ppulse, it may be indicative that an obstruction or clog is present within the dishwashing appliance, and the method 600 may proceed to 644.

At 642, the method 600 includes a pass-through sequence. For instance, as 642 begins, the drain pump may still be in (e.g., maintained in) an active state. The method 600 may repeatedly check to ensure an overall time period has not expired. Generally, the overall time period may be a limit in the amount of time the drain cycle for the drain cycle. Prior to the overall time period expiring at 642, the drain pump may remain active (e.g., continuously active in an attempt to motivate a substantially continuous or non-pulsated fluid flow). Upon expiration of the drain overall time period, however, 642 may include deactivating the drain pump (e.g., as an end to the drain cycle).

At 644, the method 600 includes directing an obstruction response. For instance, the method may include determining whether prior instances have occurred during the drain cycle at which Pdiff is less than Ppulse. Each such determination during a discrete drain cycle may recorded and labeled as a "count" (e.g., stored within the memory of the controller). Each new count may be added together to obtain a current count value that is compared to a maximum count value.

If the maximum count value has not been reached, 644 may initiating a response sequence (e.g., at the drain pump). As an example, the response sequence may include or be provided as a pulsating sequence. The pulsating sequence may include activating the drain pump for a pulsating activation period during which the drain pump is active according to a set pulsating pattern. Thus, the drain pump may draw wash fluid at an interrupted pace with sequential, discrete pulses, as is understood. Wash fluid may be dispensed from the drain conduit at the interrupted pace. Upon completion of the response sequence at 640, the method 600 may continue the drain cycle (e.g., by returning to 610).

If the maximum count has been reached, 644 may include initiating a fault sequence. For instance, the fault sequence may include or be provided as a notification sequence or halting sequence. The notification sequence may include initiating an audio or visual alert. As an example, a controller may direct a speaker to generate an audible sound wave corresponding to a detected condition. As another example, a controller may direct a light source or display of the user interface to transmit a visual identifier corresponding to a fault condition. The halting sequence may include immediately directing the wash appliance to halt the drain pump or drain cycle.

Turning now to FIG. 7, the method 700 may describe operation of a dishwashing appliance (e.g., at the circulation pump) during a circulation phase of a wash cycle or rinse cycle (e.g., a portion of the corresponding cycle in which circulation of a wash fluid within dishwashing appliance is preferred) after wash fluid has been supplied to the wash chamber. Thus, the method 700 may be initiated while a volume of wash fluid is contained within wash chamber.

At 710, the method 700 includes detecting a pressure (P1) (e.g., as a value of relative pressure or hydrostatic pressure, such as value in units of $mmH_2O$) at the pressure sensor upstream from the circulation pump while maintaining the circulation pump in an inactive state. For instance, all pumps in fluid communication with the wash chamber may be directed to or maintained in an inactive state such that no wash fluid is actively urged or pumped therethrough during 710. Additionally or alternatively, a water valve configured to direct water to the wash chamber, as described above, may be closed such that no new water is provided to wash chamber during 710. Thus, wash fluid within wash chamber may be generally static At 720, the method includes activating the circulation pump (e.g., from an inactive state). For instance, the circulation pump may actively urge or motivate a fluid flow. In some embodiments, the activated circulation pump is directed to operate uninterrupted in an attempt to motivate a substantially continuous or non-pulsated fluid flow (e.g., as in a continuous flow state). As described above, the fluid flow may be directed through one or more conduits, diverters, or spray assemblies.

If an overall time period has not expired, the method 700 may proceed to 730 (e.g., while maintaining the circulation pump in an active state). By contrast, if the overall time period has expired, the corresponding cycle may proceed to another portion of the corresponding cycle (e.g., wash cycle or rinse cycle) or to another cycle (e.g., drain cycle).

At 730, the method 700 may include evaluating an active pumping pressure. Specifically, 730 may include detecting a pressure (P2) (e.g., as a value of relative pressure in millimeters of water) at the pressure sensor upstream from the circulation pump while the circulation pump continues to actively operate to urge or motivate a fluid flow (e.g., in a continuous flow state). Specifically, P2 is detected during the activation period. Thus, P2 may be an active pumping pressure.

Once obtained, the detected pressure P2 may be evaluated alone. For instance, P2 may be compared to a predetermined limit pressure (Plimit) (e.g., as a value of relative pressure in millimeters of water). From the comparison, it may be determined whether P2 is less than or equal to Plimit.

If P2 is not less or equal to Plimit (i.e., P2 is greater than Plimit), it may be indicative of normal or desirable fluid flow through the dishwashing appliance. Moreover, the method 700 may return to 720. If P2 is less or equal to Plimit, the method 700 may proceed to 740.

At 740, the method 700 includes evaluating an inactive pumping pressure. Specifically, 740 may include deactivating the circulation pump for a deactivation period during which the circulation pump remains inactive. All other pumps in fluid communication with the wash chamber (e.g., drain pump) may also remain inactive. After the circulation pump has been deactivated, 740 may include detecting a pressure (P3) at the pump sensor upstream from the circulation pump during the deactivation period (i.e., while the pump remains inactive).

After detecting P3, 740 may include calculating a difference (Pcomp) between P1 and P3 (e.g., Pcomp=P1−P3). When calculated, Pcomp may generally indicate the change in fluid volume within the wash chamber (e.g., at the pressure sensor) from 710 to 740. Moreover, Pcomp may be compared to a predetermined leak pressure (Pleak), for instance, to determine if a leak in the dishwashing appliance or a large article collecting wash fluid is present.

If Pcomp is not less than or equal Pleak (i.e., Pcomp is greater than Pleak), the method 700 may return to 710 (e.g., after reactivating the circulation pump in a continuous flow state). Additionally or alternatively, a flagging sequence or notification sequence may be initiated, as described above. If Pcomp is less than or equal to Pleak, the method 700 may proceed to 750.

At 750, the method 700 includes initiating a response. For instance, the response may include a flagging sequence such that the method 700 flags the current condition for a response. If a filter clean sequence is available, the filter clean sequence may be initiated (e.g., as described above). If a filter clean sequence is not available, a pulsating sequence may be initiated (e.g., such that the circulation pump is activated for a pulsating activation period), as described above.

Upon completion of the filter clean sequence or pulsating sequence, the method 700 may return to 710 (e.g., after reactivating the circulation pump in a continuous flow state).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance comprising a sump, a pressure sensor mounted within the sump, and a circulation pump downstream from the pressure sensor, the method comprising:

detecting a pressure (P1) at the pressure sensor upstream from the circulation pump while maintaining the circulation pump in an inactive state while a volume of wash fluid is contained within a wash chamber;

activating, following detecting P1, the circulation pump from the inactive state for an activation period during which the circulation pump remains active to motivate a continuous fluid flow comprising the volume of wash fluid;

detecting a pressure (P2) at the pressure sensor upstream from the circulation pump during the activation period;

comparing P2 to a predetermined pressure value (Plimit);

deactivating, in response to P2 being greater than Plimit, the circulation pump for a deactivation period during which the circulation pump remains inactive;

detecting a pressure (P3) at the pressure sensor upstream from the circulation pump during the deactivation period;

calculating a pressure difference (Pcomp) between P1 and P3;

comparing Pcomp to a predetermined leak pressure (Pleak); and initiating a response sequence at the circulation pump based on the comparison of Pcomp to Pleak.

2. The method of claim 1, wherein the dishwashing appliance further comprises a drain pump, and wherein the method further comprises:

calculating a difference (Pdiff) between P1 and P2; and comparing Pdiff to a predetermined pulse pressure (Ppulse), wherein the response sequence comprises, in response to Pdiff being less than Ppulse, activating the drain pump for a pulsating activation period during which the drain pump is active according to a set pulsating pattern.

3. The method of claim 1, wherein the dishwashing appliance further comprises a drain pump, and wherein the method further comprises:

calculating a pressure difference (Pdiff) between P1 and P2; and comparing Pdiff to a predetermined pulse pressure (Ppulse), wherein the response sequence comprises, in response to Pdiff being greater than or equal to Ppulse, activating the drain pump for a continuous drain period during which the drain pump is active to direct wash fluid from the dishwashing appliance.

4. The method of claim 1, wherein the response sequence comprises activating the circulation pump for a continuous circulation period during which the circulation pump is active to circulate wash fluid within the wash chamber through a spray assembly downstream from the circulation pump.

5. The method of claim 1, wherein the response sequence comprises activating the circulation pump for a pulsating activation period during which the circulation pump is active according to a set pulsating pattern.

6. The method of claim 1, wherein the response sequence comprises, in response to Pcomp being greater than Pleak, activating the circulation pump for a continuous circulation period during which the circulation pump is active to circulate wash fluid within the wash chamber through a spray assembly.

7. The method of claim 1, wherein the response sequence comprises, in response to Pcomp being less than or equal to Pleak, activating the circulation pump for a pulsating activation period during which the circulation pump is active according to a set pulsating pattern.

8. A dishwashing appliance, comprising:

a cabinet;

a tub positioned within the cabinet and defining a wash chamber for receipt of articles for washing;

a spray assembly positioned within the wash chamber;

a circulation pump in fluid communication with the wash chamber;

a pressure sensor upstream of the circulation pump in fluid communication between the tub and the circulation pump; and a controller in operative communication with the pressure sensor and the circulation pump, the controller being configured to initiate a wash operation while a volume of wash fluid is contained within the wash chamber, the wash operation comprising detecting a pressure (P1) at the pressure sensor upstream from the circulation pump while maintaining the circulation pump in an inactive state and while the volume of wash fluid is contained within the wash chamber, activating, following detecting P1, the circulation pump from the inactive state for an activation period during which the circulation pump remains active to motivate a continuous fluid flow comprising the volume of wash fluid, detecting a pressure (P2) at the pressure sensor upstream from the circulation pump during the activation period, comparing P2 to a predetermined pressure value (Plimit), deactivating, in response to P2 being greater than Plimit, the circulation pump for a deactivation period during which the circulation pump remains inactive, detecting a pressure (P3) at the pressure sensor upstream from the circulation pump during the deactivation period, calculating a pressure difference (Pcomp) between P1 and P3, comparing Pcomp to a predetermined leak pressure (Pleak), and initiating a response sequence at the circulation pump based on the comparison of Pcomp to Pleak.

9. The dishwashing appliance of claim 8, wherein the dishwashing appliance further comprises a drain pump, and wherein the wash operation further comprises calculating a difference (Pdiff) between P1 and P2, and comparing Pdiff to a predetermined pulse pressure (Ppulse), wherein the response sequence comprises, in response to Pdiff being less than Ppulse, activating the drain pump for a pulsating activation period during which the drain pump is active according to a set pulsating pattern.

10. The dishwashing appliance of claim 8, wherein the dishwashing appliance further comprises a drain pump, and wherein the wash operation further comprises calculating a pressure difference (Pdiff) between P1 and P2, and comparing Pdiff to a predetermined pulse pressure (Ppulse), wherein the response sequence comprises, in response to Pdiff being greater than or equal to Ppulse, activating the drain pump for a continuous drain period during which the drain pump is active to direct wash fluid from the dishwashing appliance.

11. The dishwashing appliance of claim 8, wherein the response sequence comprises activating the circulation pump for a continuous circulation period during which the circulation pump is active to circulate wash fluid within the wash chamber through the spray assembly downstream from the circulation pump.

12. The dishwashing appliance of claim 8, wherein the response sequence comprises activating the circulation pump for a pulsating activation period during which the circulation pump is active according to a set pulsating pattern.

13. The dishwashing appliance of claim 8, wherein the response sequence comprises, in response to Pcomp being greater than Pleak, activating the circulation pump for a continuous circulation period during which the circulation pump is active to circulate wash fluid within the wash chamber through the spray assembly.

14. The dishwashing appliance of claim 8, wherein the response sequence comprises, in response to Pcomp being less than or equal to Pleak, activating the circulation pump for a pulsating activation period during which the circulation pump is active according to a set pulsating pattern.

15. A dishwashing appliance, comprising:

a cabinet;

a tub positioned within the cabinet and defining a wash chamber for receipt of articles for washing;

a spray assembly positioned within the wash chamber;

a circulation pump in fluid communication with the wash chamber;

a pressure sensor upstream of the circulation pump in fluid communication between the tub and the pump; and a controller in operative communication with the pressure sensor and the circulation pump, the controller being configured to initiate a wash operation while a volume of wash fluid is contained within the wash chamber, the wash operation comprising detecting a pressure (P1) at the pressure sensor upstream from the circulation pump while maintaining the circulation pump in an inactive state and while the volume of wash fluid is contained within the wash chamber, activating, following detecting P1, the circulation pump from the inactive state for an activation period during which the circulation pump remains active to motivate a continuous fluid flow comprising the volume of wash fluid, detecting a pressure (P2) at the pressure sensor upstream from the circulation pump during the activation period, comparing P2 to a predetermined pressure value (Plimit), deactivating, subsequent to comparing P2 to Plimit, the circulation pump for a deactivation period during which the circulation pump remains inactive, detecting a pressure (P3) at the pressure sensor upstream from the circulation pump during the deactivation period, calculating a pressure difference (Pcomp) between P1 and P3, comparing Pcomp to a predetermined leak pressure (Pleak), activating, in response to comparing Pcomp to Pleak, the circulation pump for a pulsating activation period during which the circulation pump is active according to a set pulsating pattern.

* * * * *